US011649990B2

(12) United States Patent
Semura

(10) Patent No.: US 11,649,990 B2
(45) Date of Patent: May 16, 2023

(54) COMPRESSOR SYSTEM FOR CRYOCOOLER AND AUXILIARY COOLING DEVICE

(71) Applicant: SUMITOMO HEAVY INDUSTRIES, LTD., Tokyo (JP)

(72) Inventor: Kenta Semura, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 291 days.

(21) Appl. No.: 17/161,529

(22) Filed: Jan. 28, 2021

(65) Prior Publication Data

US 2021/0270500 A1 Sep. 2, 2021

(30) Foreign Application Priority Data

Feb. 28, 2020 (JP) ..... JP2020-033085

(51) Int. Cl.
*F25B 9/14* (2006.01)
*F04D 29/06* (2006.01)
*F04D 29/58* (2006.01)

(52) U.S. Cl.
CPC ..... *F25B 9/14* (2013.01); *F04D 29/06* (2013.01); *F04D 29/5866* (2013.01)

(58) Field of Classification Search
CPC ..... F25B 9/14
See application file for complete search history.

(56) References Cited

U.S. PATENT DOCUMENTS

2017/0176070 A1 6/2017 Sloan et al.

FOREIGN PATENT DOCUMENTS

JP 2000124184 A 4/2000
JP 2019505751 A 2/2019

*Primary Examiner* — Nael N Babaa
(74) *Attorney, Agent, or Firm* — Hea Law PLLC

(57) ABSTRACT

A compressor system for a cryocooler includes a compressor unit that includes a compressor main body compressing a refrigerant gas of the cryocooler and a liquid-cooled heat exchanger cooling, through heat exchange with a cooling liquid, at least one of the refrigerant gas compressed by the compressor main body and an oil lubricating the compressor main body, a supply line through which the cooling liquid is supplied from a main chiller to the liquid-cooled heat exchanger, a collecting line through which the cooling liquid is collected from the liquid-cooled heat exchanger to the main chiller, and a backup chiller that is provided outside the compressor unit, circulates the cooling liquid to the liquid-cooled heat exchanger in place of or together with the main chiller, and includes a circulation pump and a cooler cooling the cooling liquid on an inlet side or outlet side of the pump.

7 Claims, 2 Drawing Sheets

COMPRESSOR SYSTEM FOR CRYOCOOLER AND AUXILIARY COOLING DEVICE

RELATED APPLICATIONS

The content of Japanese Patent Application No. 2020-033085, on the basis of which priority benefits are claimed in an accompanying application data sheet, is in its entirety incorporated herein by reference.

BACKGROUND

Technical Field

Certain embodiments of the present invention relate to a compressor system for a cryocooler and an auxiliary cooling device.

Description of Related Art

An oil-lubricated helium compressor with a dual aftercooler is proposed (for example, refer to the related art). Two after coolers that cool helium and an oil, that is, a water-cooled aftercooler and an air-cooled aftercooler are built in the compressor. The air-cooled aftercooler is disposed in series or in parallel with the water-cooled aftercooler. By operating a fan of the air-cooled aftercooler, redundancy in a case where a cooling water circuit of the water-cooled aftercooler is blocked is provided.

SUMMARY

The present inventor has examined the compressor described above and has recognized the followings. As a matter of fact, emergency situations in which a cooling fan is to be operated is usually rare. In a case where the frequency of operation is extremely low, a risk in which the sticking of the cooling fan occurs can be high. When the sticking occurs, the fan cannot blow wind. For this reason, there is a concern over the reliability of redundancy using the cooling fan. In addition, the air-cooled aftercooler has a size corresponding thereto. When the air-cooled aftercooler is built in, the size of the compressor becomes larger, and manufacturing costs can increase.

According to an embodiment of the present invention, there is provided a compressor system for a cryocooler including a compressor unit that includes a compressor main body compressing a refrigerant gas of the cryocooler and a liquid-cooled heat exchanger cooling, through heat exchange with a cooling liquid, at least one of the refrigerant gas compressed by the compressor main body and an oil lubricating the compressor main body, a supply line through which the cooling liquid is supplied from a main chiller to the liquid-cooled heat exchanger, a collecting line through which the cooling liquid is collected from the liquid-cooled heat exchanger to the main chiller, and a backup chiller that is provided outside the compressor unit, circulates the cooling liquid to the liquid-cooled heat exchanger in place of the main chiller or together with the main chiller, and includes a circulation pump and a cooler cooling the cooling liquid on an inlet side or an outlet side of the circulation pump.

According to another embodiment of the present invention, there is provided an auxiliary cooling device for a compressor unit for a cryocooler including a supply line through which a cooling liquid is supplied from a main chiller to a liquid-cooled heat exchanger built in the compressor unit, a collecting line through which the cooling liquid is collected from the liquid-cooled heat exchanger to the main chiller, and a backup chiller that is provided outside the compressor unit, circulates the cooling liquid to the liquid-cooled heat exchanger in place of the main chiller or together with the main chiller, and includes a circulation pump and a cooler cooling the cooling liquid on an inlet side or an outlet side of the circulation pump.

Any combination of the components described above and a combination obtained by switching the components and expressions of the present invention between methods, devices, and systems are also effective as an embodiment of the present invention.

DETAILED DESCRIPTION

It is desirable to provide redundancy in cooling in a compressor system for a cryocooler.

Hereinafter, an embodiment for carrying out the present invention will be described in detail with reference to the drawings. In the description and drawings, the same or equivalent components, members, and processes will be assigned with the same reference symbols, and redundant description thereof will be omitted as appropriate. The scales and shapes of the illustrated parts are set for convenience in order to make the description easy to understand, and are not to be understood as limiting unless stated otherwise. The embodiment is merely an example and does not limit the scope of the present invention. All characteristics and combinations to be described in the embodiment are not necessarily essential to the invention.

Figure 1:
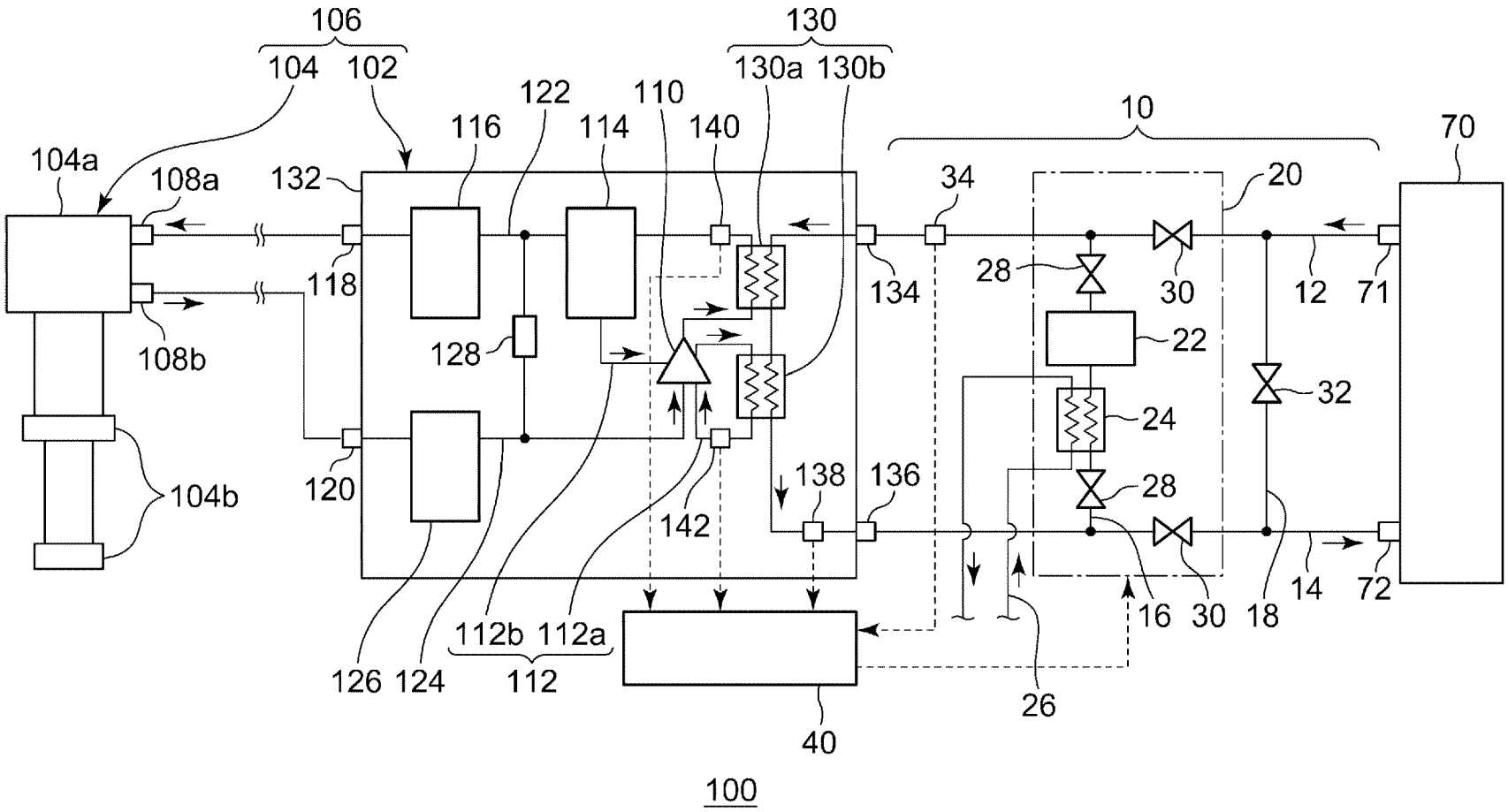
FIG. 1 is a diagram schematically showing a compressor system for a cryocooler according to an embodiment.

FIG. 1 is a diagram schematically showing a compressor system for a cryocooler according to the embodiment. A compressor system 100 includes a compressor unit 102 and an auxiliary cooling device 10. The compressor system 100 configures a cryocooler 106 together with a cold head 104. In addition, a main chiller 70 is provided in order to cool the compressor unit 102. A cooling system for the compressor unit 102 is configured by the main chiller 70 and the auxiliary cooling device 10.

The compressor unit 102 is configured to collect a refrigerant gas of the cryocooler 106 from the cold head 104, to pressurize the collected refrigerant gas, and to supply the refrigerant gas to the cold head 104 again. The cold head 104 is also called an expander and has a room temperature section 104*a* and a low-temperature section 104*b* which is also called a cooling stage. The compressor unit 102 and the cold head 104 configure a refrigeration cycle of the cryocooler 106, and thereby the low-temperature section 104*b* is cooled to a desired cryogenic temperature. The refrigerant gas is also called a working gas, and other suitable gases may be used although a helium gas is typically used.

Although the cryocooler 106 is, for example, a single-stage or two-stage Gifford-McMahon (GM) cryocooler, the cryocooler may be a pulse tube cryocooler, a Stirling cryocooler, or other types of cryocoolers. Although the cold head 104 has a different configuration depending on the type of the cryocooler 106, the compressor unit 102 can use the configuration described below regardless of the type of the cryocooler 106.

In general, both of the pressure of a refrigerant gas supplied from the compressor unit 102 to the cold head 104 and the pressure of a refrigerant gas collected from the cold head 104 to the compressor unit 102 are significantly higher than the atmospheric pressure, and can be called a first high pressure and a second high pressure, respectively. For convenience of description, the first high pressure and the second high pressure are also simply called a high pressure and a low pressure, respectively. Typically, the high pressure is, for example, 2 to 3 MPa. The low pressure is, for example, 0.5 to 1.5 MPa, and is, for example, approximately 0.8 MPa.

The compressor unit 102 includes a compressor main body 110, an oil line 112, an oil separator 114, and an adsorber 116. In addition, the compressor unit 102 includes a discharge port 118, a suction port 120, a discharge flow path 122, a suction flow path 124, a storage tank 126, a bypass valve 128, and a liquid-cooled heat exchanger 130. The liquid-cooled heat exchanger 130 includes a refrigerant gas cooling unit 130*a* and an oil cooling unit 130*b*. Further, the compressor unit 102 includes a compressor casing 132 that accommodates each of components of the compressor unit 102, including the compressor main body 110, the oil separator 114, and the liquid-cooled heat exchanger 130.

The compressor main body 110 is configured to internally compress a refrigerant gas sucked from a suction port thereof and to discharge the refrigerant gas from a discharge port. The compressor main body 110 may be, for example, a scroll type pump, a rotary type pump, or other pumps that pressurize the refrigerant gas. The compressor main body 110 may be configured to discharge the refrigerant gas at a fixed and constant flow rate. Alternatively, the compressor main body 110 may be configured to change the flow rate of the refrigerant gas to be discharged. The compressor main body 110 is called a compression capsule in some cases.

An oil is used in the compressor main body 110 for the sake of cooling and lubrication, and a sucked refrigerant gas is directly exposed to the oil in the compressor main body 110. Accordingly, the refrigerant gas is delivered from the discharge port in a state where the oil is slightly mixed.

The oil line 112 includes an oil circulation line 112*a* and an oil return line 112*b*. The oil circulation line 112*a* is configured such that an oil flowing out from the compressor main body 110 flows into the compressor main body 110 again through the oil cooling unit 130*b*. An orifice that controls the flow rate of the oil flowing inside is provided in the oil circulation line 112*a*. In addition, a filter that removes dust included in the oil may be provided in the oil circulation line 112*a*. The oil return line 112*b* connects the oil separator 114 to the compressor main body 110 in order to return the oil collected by the oil separator 114 to the compressor main body 110. In the middle of the oil return line 112*b*, the filter that removes dust included in the oil separated out by the oil separator 114 and the orifice that controls the amount of the oil returning to the compressor main body 110 may be provided.

The oil separator 114 is provided in order to separate an oil, which is mixed in the refrigerant gas as passing through the compressor main body 110, out from the refrigerant gas by causing the refrigerant gas. The adsorber 116 is provided in order to remove, for example, a vaporized oil and other contaminants remaining in the refrigerant gas from the refrigerant gas through adsorption. The oil separator 114 and the adsorber 116 are connected in series. In the discharge flow path 122, the oil separator 114 is disposed on a compressor main body 110 side, and the adsorber 116 is disposed on a discharge port 118 side.

The discharge port 118 is an outlet of a refrigerant gas that is provided in the compressor casing 132 in order to deliver the refrigerant gas, which is pressurized to a high pressure by the compressor main body 110, from the compressor unit 102, and the suction port 120 is an inlet of the refrigerant gas that is provided in the compressor casing 132 in order for the compressor unit 102 to receive the low-pressure refrigerant gas. The discharge port 118 and the suction port 120 are connected to a high pressure port 108*a* and a low pressure port 108*b* of the cold head 104, respectively, via a refrigerant gas pipe. The high pressure port 108*a* and the low pressure port 108*b* are provided in the room temperature section 104*a* of the cold head 104. In the compressor unit 102, a gas discharge port of the compressor main body 110 is connected to the discharge port 118 by the discharge flow path 122, and the suction port 120 is connected to a gas suction port of the compressor main body 110 by the suction flow path 124.

The storage tank 126 is provided as a volume for removing pulsation included in a low-pressure refrigerant gas returning from the cold head 104 to the compressor unit 102. The storage tank 126 is disposed on the suction flow path 124.

The bypass valve 128 connects the discharge flow path 122 to the suction flow path 124 to bypass the compressor main body 110. For example, the bypass valve 128 branches off from the discharge flow path 122 between the oil separator 114 and the adsorber 116, and is connected to the suction flow path 124 between the compressor main body 110 and the storage tank 126. The bypass valve 128 is provided in order to control the flow rate of a refrigerant gas and/or in order to equalize the discharge flow path 122 and the suction flow path 124 when the compressor unit 102 is stopped.

Therefore, a refrigerant gas to be collected from the cold head 104 to the compressor unit 102 flows from the low pressure port 108*b* into the suction port 120 of the compressor unit 102. The refrigerant gas is collected into the gas suction port of the compressor main body 110 via the storage tank 126 on the suction flow path 124. The refrigerant gas is compressed and pressurized by the compressor main body 110. The refrigerant gas to be delivered from the discharge port of the compressor main body 110 exits the compressor unit 102 from the discharge port 118 via the refrigerant gas cooling unit 130*a*, the oil separator 114, and the adsorber 116 which are on the discharge flow path 122. The refrigerant gas is supplied from the high pressure port 108*a* into the cold head 104.

The liquid-cooled heat exchanger 130 is built in the compressor unit 102 as a main cooling device for the compressor unit 102. The liquid-cooled heat exchanger 130 is configured to cool a refrigerant gas compressed by the compressor main body 110 and an oil lubricating the compressor main body 110 through heat exchange with a cooling liquid or a cooling fluid. Typically, the cooling liquid is cooling water such as tap water and industrial water.

The refrigerant gas cooling unit 130*a* is disposed on the discharge flow path 122 in order to cool a high-pressure refrigerant gas heated by compression heat generated with the compression of a refrigerant gas in the compressor main body 110. In the embodiment, the refrigerant gas cooling unit 130*a* is disposed between the gas discharge port of the compressor main body 110 and the oil separator 114 on the discharge flow path 122. The oil cooling unit 130*b* is disposed on the oil circulation line 112*a* in order to cool an oil flowing in the oil circulation line 112*a*.

A cooling liquid inlet port 134 and a cooling liquid outlet port 136 are provided in the compressor casing 132. An inlet side of the liquid-cooled heat exchanger 130 is connected to the cooling liquid inlet port 134, and an outlet side of the liquid-cooled heat exchanger 130 is connected to the cooling liquid outlet port 136, forming an internal cooling liquid flow path of the compressor unit 102. The cooling liquid flows from the cooling liquid inlet port 134 into the compressor unit 102, and is supplied to the liquid-cooled heat exchanger 130. The cooling liquid used in cooling a refrigerant gas and an oil in the liquid-cooled heat exchanger 130 is discharged outside the compressor unit 102 from the liquid-cooled heat exchanger 130 through the cooling liquid outlet port 136. The refrigerant gas cooling unit 130*a* and the oil cooling unit 130*b* are connected in series. On the internal cooling liquid flow path of the compressor unit 102, the refrigerant gas cooling unit 130*a* is disposed on a cooling liquid inlet port 134 side, and the oil cooling unit 130*b* is disposed on a cooling liquid outlet port 136 side.

Although the liquid-cooled heat exchanger 130 is configured to cool both of a refrigerant gas and an oil in the embodiment, the invention is not limited thereto. The liquid-cooled heat exchanger 130 may be configured to cool only one of the refrigerant gas and the oil. In this case, for example, the compressor unit 102 may have two liquid-cooled heat exchangers, that is, may have a heat exchanger that cools the refrigerant gas and a heat exchanger that cools the oil.

A cooling liquid is supplied from the main chiller 70 to the compressor unit 102 through the cooling liquid inlet port 134. The cooling liquid used in cooling is collected in the main chiller 70 from the compressor unit 102 through the cooling liquid outlet port 136.

The main chiller 70 is configured to adjust the temperate of a cooling liquid and to circulate the cooling liquid. The cooling liquid is cooled by the main chiller 70 to, for example, a temperature that is lower than the room temperature and higher than a freezing point (0° C. in the case of water) of the cooling liquid. The main chiller 70 may be, for example, a known water chiller. The main chiller 70 does not need to be provided as a dedicated cooling liquid source for the compressor unit 102, and rather can be shared by a plurality of devices that need a cooling liquid. Accordingly, the main chiller 70 may be connected to various devices used in factories, hospitals, or other locations where the cryocooler 106 is provided and used to provide a cooling liquid to the devices.

The auxiliary cooling device 10 includes a supply line 12 through which a cooling liquid is supplied from the main chiller 70 to the liquid-cooled heat exchanger 130 and a collecting line 14 through which the cooling liquid is collected from the liquid-cooled heat exchanger 130 to the main chiller 70. The supply line 12 connects a cooling liquid supply port 71 of the main chiller 70 to the cooling liquid inlet port 134 of the compressor unit 102. The collecting line 14 connects a cooling liquid collecting port 72 of the main chiller 70 to the cooling liquid outlet port 136 of the compressor unit 102.

Each of the supply line 12 and the collecting line 14 may be an appropriate pipe or an appropriate flow path which is suitable for transporting a cooling liquid, such as a flexible pipe and a rigid pipe. Each of ends of the supply line 12 and the collecting line 14 may be a joint that can be attached or detached, such as a self-sealing coupling. In this case, it is easy to attach or detach the auxiliary cooling device 10 to the main chiller 70 and the compressor unit 102, which is convenient.

The auxiliary cooling device 10 includes a backup chiller 20 that is provided outside the compressor unit 102 and circulates a cooling liquid to the liquid-cooled heat exchanger 130 in place of the main chiller 70 or together with the main chiller 70.

The backup chiller 20 includes a circulation pump 22 and a cooler 24 connected to the circulation pump 22 in series. In the embodiment, the cooler 24 cools a cooling liquid, on the inlet side of the circulation pump 22. However, without being limited thereto, the cooler 24 may cool the cooling liquid, on the outlet side of the circulation pump 22.

The backup chiller 20 is provided in parallel with the main chiller 70 with respect to the compressor unit 102. The backup chiller 20 includes a connecting line 16 that connects the supply line 12 and the collecting line 14 to each other. The circulation pump 22 and the cooler 24 are provided on the connecting line 16.

The circulation pump 22 circulates a cooling liquid from the collecting line 14 to the supply line 12. Insofar as a pump has a pumping ability to recover a pressure loss of the collecting line 14 with respect to the supply line 12 and is appropriate for properties of the cooling liquid such as the type or composition of the cooling liquid, a known pump can be used as the circulation pump 22 as appropriate.

For example, the cooler 24 is a liquid-cooled heat exchanger. Accordingly, the liquid-cooled heat exchanger 130 of the compressor unit 102 is also called a first liquid-cooled heat exchanger and the cooler 24 is also called a second liquid-cooled heat exchanger. The cooler 24 is configured to cool a first cooling liquid through heat exchange between the first cooling liquid collected from the liquid-cooled heat exchanger 130 and a second cooling liquid flowing in a second cooling liquid line 26.

The second cooling liquid line 26 may be a non-circulating type that exhausts a cooling liquid used in cooling to the outside (for example, sewage), and the second cooling liquid may be cooling water such as tap water and industrial water. Alternatively, the second cooling liquid line 26 may be a circulating type, and may be connected to the main chiller 70 such that cooling water is circulated by the main chiller 70. The second cooling liquid line 26 may be a second water chiller provided separately from the main chiller 70. Alternatively, the second cooling liquid line 26 may be configured to allow, for example, a cooling oil and other cooling liquids or cooling fluids to be circulated.

Each of the supply line 12 and the collecting line 14 is separably connected to the main chiller 70 on a main chiller 70 side with respect to the connecting line 16. The supply line 12 and the collecting line 14 may be disconnected from the main chiller 70 by closing a valve to be described later. Alternatively, by removing the supply line 12 and the collecting line 14 from the cooling liquid supply port 71 and the cooling liquid collecting port 72 respectively, the supply line 12 and the collecting line 14 may be disconnected from the main chiller 70.

The backup chiller 20 includes a set of first valves 28 and a set of second valves 30. Both of the first valves 28 and the second valves 30 are, for example, on/off valves. Instead of a combination of the first valves 28 and the second valves 30, a three-way valve may be provided.

On the connecting line 16, one of the set of first valves 28 is provided on a supply line 12 side, the other one is provided on a collecting line 14 side, and the circulation pump 22 and the cooler 24 are disposed between the two first valves 28. The first valves 28 are opened and closed in synchronization with each other. When both of the first valves 28 are open, the backup chiller 20 is connected to the liquid-cooled heat exchanger 130. When both of the first valves 28 are closed, the backup chiller 20 is disconnected from the liquid-cooled heat exchanger 130.

One of the set of second valves 30 is provided on the supply line 12 and the other one is provided on the collecting line 14. Both of the two second valves 30 are disposed on the main chiller 70 side with respect to the connecting line 16. The second valves 30 are also opened and closed in synchronization with each other. When both of the second valves 30 are open, the main chiller 70 is connected to the liquid-cooled heat exchanger 130. When both of the second valves 30 are closed, the main chiller 70 is disconnected from the liquid-cooled heat exchanger 130. Alternatively, the second valves 30 may be check valves that are disposed to prevent backflow in the supply line 12 and the collecting line 14 respectively.

The auxiliary cooling device 10 may include a bypass line 18 that connects the supply line 12 and the collecting line 14 to each other on the main chiller 70 side with respect to the connecting line 16. The bypass line 18 is a part of a flow path that bypasses the liquid-cooled heat exchanger 130 and the backup chiller 20 and circulates a cooling liquid to the main chiller 70.

A third valve 32 is provided on the bypass line 18. The third valve 32 is, for example, an on/off valve. When the third valve 32 is open, a flow of a cooling liquid which has passed through the bypass line 18 from the collecting line 14 to the supply line 12 is allowed, and the flow of the cooling liquid that has passed through the bypass line 18 is blocked when the third valve 32 is closed. The third valve 32 may be a check valve that allows the flow of the cooling liquid from the collecting line 14 to the supply line 12 and blocks backflow.

In a case where the bypass line 18 is provided in the auxiliary cooling device 10, the second valves 30 are disposed on a backup chiller 20 side with respect to the bypass line 18. Therefore, a flow path of a cooling liquid from the cooling liquid supply port 71 of the main chiller 70 to the cooling liquid collecting port 72 through the bypass line 18 is formed when the second valves 30 are closed and the third valve 32 is open. That is, a cooling liquid circulation path for the main chiller 70, which does not pass through the liquid-cooled heat exchanger 130 of the compressor unit 102, is formed by the bypass line 18.

Each of the connecting line 16 and the bypass line 18 may be attachable or detachable to or from the supply line 12 and the collecting line 14. In addition, each of the connecting line 16 and the bypass line 18 may be an appropriate pipe or an appropriate flow path which is suitable for transporting a cooling liquid, such as a flexible pipe and a rigid pipe.

Components of the auxiliary cooling device 10, such as the backup chiller 20 and the bypass line 18, may be provided as one unit accommodated in a casing like the compressor unit 102. Compared to a case where the parts are individually prepared, an operation of attaching the auxiliary cooling device 10 to the compressor unit 102 and the main chiller 70 is easy.

Various types of sensors are provided in the compressor system 100. For example, the compressor unit 102 includes a first temperature sensor 138 that measures the temperature of a cooling liquid. The first temperature sensor 138 is provided, for example, on the outlet side of the liquid-cooled heat exchanger 130, that is, between the liquid-cooled heat exchanger 130 and the cooling liquid outlet port 136 on the internal cooling liquid flow path of the compressor unit 102. In addition thereto or instead thereof, another cooling liquid temperature sensor that measures the temperature of the cooling liquid may be provided on the inlet side of the liquid-cooled heat exchanger 130.

In addition, the compressor unit 102 may include a second temperature sensor 140 that measures the temperature of a refrigerant gas. The second temperature sensor 140 may be provided on the discharge flow path 122, for example, between the refrigerant gas cooling unit 130*a* and the oil separator 114. In addition thereto or instead thereof, another refrigerant gas temperature sensor that measures the temperature of the refrigerant gas may be provided between the discharge port of the compressor main body 110 and the refrigerant gas cooling unit 130*a*. The compressor unit 102 may include a third temperature sensor 142 that measures the temperature of an oil. The third temperature sensor 142 may be provided on the oil circulation line 112*a*, between an oil inlet of the compressor main body 110 and the oil cooling unit 130*b*.

The backup chiller 20 includes a sensor 34 that measures the temperature of a cooling liquid. The sensor 34 is disposed on the supply line 12. The sensor 34 is disposed on a compressor unit 102 side with respect to the connecting line 16. Accordingly, not only a cooling liquid supplied from the backup chiller 20 to the compressor unit 102 but also a cooling liquid supplied from the main chiller 70 to the compressor unit 102 can be measured. The sensor 34 may measure the flow rate or the pressure of the cooling liquid, instead of or in addition to the temperature of the cooling liquid. In other words, the sensor 34 may be configured by one or a plurality of sensors, and can include, for example, at least one of a temperature sensor, a flow rate sensor, and a pressure sensor. In addition to the sensor 34 or instead of the sensor 34, another sensor that measures the temperature, the flow rate, or the pressure of the cooling liquid may be provided on the collecting line 14.

A controller 40 that activates the backup chiller 20 is provided in the backup chiller 20. The controller 40 is configured to receive, from at least one sensor, a sensor signal indicating measurement results by the sensor, and to activate the backup chiller 20 based on the measurement results. The controller 40 is configured to control components of the backup chiller 20, such as the turning on and off of the circulation pump 22 and the opening and closing of the first valves 28.

For example, the controller 40 may activate the backup chiller 20 based on the temperature of a cooling liquid, which is measured by the first temperature sensor 138. In this case, the controller 40 receives a first temperature sensor signal indicating the measured temperature of the cooling liquid from the first temperature sensor 138, and compares the measured temperature with a temperature threshold. Ina case where a cooling liquid temperature is higher than the threshold, the temperature threshold is set to a value at which a cooling liquid is evaluated to have an excessively high temperature.

As one reason why a cooling liquid temperature measured by the first temperature sensor 138 exceeds the temperature threshold, for example, a case where the temperature of a cooling liquid supplied from the main chiller 70 to the compressor unit 102 is excessively high (that is, the cooling failure or malfunction of the main chiller 70) is assumed.

Thus, the controller 40 activates the backup chiller 20 in a case where the measured temperature exceeds the temperature threshold. On the other hand, the controller 40 does not activate the backup chiller 20 in a case where the measured temperature does not exceed the temperature threshold.

In order to activate the backup chiller 20, the controller 40 switches the circulation pump 22 from off to on to start a cooling liquid delivering operation by the circulation pump 22, and opens the first valves 28. In a case where the second cooling liquid line 26 is also a circulating type, the controller 40 may also switch a circulation pump of the second cooling liquid line 26 from off to on. When stopping the operation of the backup chiller 20, the controller 40 switches on the circulation pump 22, and closes the first valves 28.

In this case, the controller 40 may close the second valves 30 and disconnect the main chiller 70 from the compressor unit 102. At the same time, the controller 40 may open the third valve 32. In this manner, the main chiller 70 can be disconnected from the compressor unit 102 without obstructing the flow of a cooling liquid in the main chiller 70, and can use the backup chiller 20 in place of the main chiller 70. When the main chiller 70 is disconnected from the compressor unit 102, the main chiller 70 may be inspected and repaired.

In order to activate the backup chiller 20, the controller 40 may be other sensors. It is conceivable that the temperature of a refrigerant gas or an oil in the compressor unit 102 has a correlation with the temperature of a cooling liquid collected from the liquid-cooled heat exchanger 130 or supplied to the liquid-cooled heat exchanger 130. For example, it is conceivable, as a result of cooling failure of the main chiller 70, that the cooling capacity of the liquid-cooled heat exchanger 130 is insufficient and the temperature of the refrigerant gas or the oil increases. Therefore, the controller 40 may activate the backup chiller 20 based on the temperature of the refrigerant gas, which is measured by the second temperature sensor 140. The controller 40 may activate the backup chiller 20 based on the temperature of the oil, which is measured by the third temperature sensor 142. The controller 40 may activate the backup chiller 20 based on a temperature measured by at least one temperature sensor of the first temperature sensor 138, the second temperature sensor 140, and the third temperature sensor 142.

In addition, in order to activate the backup chiller 20, the controller 40 may use the sensor 34 disposed outside the compressor unit 102. As described above, the sensor 34 may measure the temperature of a cooling liquid, and the controller 40 may activate the backup chiller 20 based on the temperature of the cooling liquid, which is measured by the sensor 34.

Alternatively, the sensor 34 may measure the flow rate or the pressure of a cooling liquid. In a case where the flow rate or the pressure of the cooling liquid is lower than the flow rate or the pressure of the threshold, as one reason for that, it is conceivable that the cooling liquid is insufficiently supplied from the main chiller 70. The threshold is set to be a value lower than the flow rate or the pressure in the supply line 12 (or the collecting line 14) when the cooling liquid is normally supplied from the main chiller 70. Accordingly, the controller 40 may activate the backup chiller 20 based on the flow rate or the pressure of the cooling liquid, which is measured by the sensor 34. The controller 40 may compare flow rate or a pressure with the threshold of the flow rate or the pressure of the cooling liquid, which is measured by the sensor 34, and activate the backup chiller 20 in a case where the measured value is lower than the threshold. On the other hand, the controller 40 does not activate the backup chiller 20 in a case where the measured value exceeds the threshold.

In a case of activating the backup chiller 20 only in an emergency such as the cooling failure or malfunction of the main chiller 70, the frequency of such a situation is usually assumed to be significantly low. The backup chiller 20 is activated in many cases after a so-called dormant period in which operation is stopped for a long period of time.

Thus, the controller 40 may activate the backup chiller 20 at any timing (for example, periodically). As described above, the activation of the backup chiller 20 by the controller 40 is not limited to being performed based on measurement results by at least one sensor provided inside or outside the compressor unit 102.

The controller 40 may receive, from at least one sensor, a sensor signal indicating measurement results by the sensor, and monitor the backup chiller 20 based on the measurement results. For example, the controller 40 compares a cooling liquid temperature measured by the first temperature sensor 138 with the temperature threshold. The controller 40 determines that the backup chiller 20 is normal in a case where the measured temperature does not exceed the temperature threshold. The controller 40 determines that there is failure in the backup chiller 20 in a case where the measured temperature exceeds the temperature threshold. In this manner, it is possible to confirm that the backup chiller 20 operates normally. An unexpected situation, in which as a result of overlooking malfunction occurred during a long operation stopped period, the backup chiller 20 cannot be operated in a case where the backup chiller is to be operated in place of the main chiller 70, can be avoided.

In order to confirm the operation of the backup chiller 20, the controller 40 may activate the backup chiller 20, close the second valves 30, and disconnect the main chiller 70 from the compressor unit 102. At the same time, the controller 40 may open the third valve 32. The operation of the backup chiller 20 can be confirmed by disconnecting the main chiller 70 from the compressor unit 102, without obstructing the flow of a cooling liquid in the main chiller 70. In a case where operation failure has occurred in the backup chiller 20, the backup chiller 20 can be repaired or replaced independently while continuing cooling by the main chiller 70 (that is, while the compressor unit 102 and the cryocooler 106 continue operating). This leads to the reliability improvement of the compressor system 100.

In a case where the controller 40 is configured to activate the backup chiller 20 based on measurement results by a sensor provided in the compressor unit 102, such as the first temperature sensor 138, the controller 40 may configure a part of a compressor controller that comprehensively controls the operation of the compressor system 100. Alternatively, in a case where the controller 40 is configured to activate the backup chiller 20 based on measurement results by a sensor provided outside the compressor unit 102, such as the sensor 34, the controller 40 may be separately provided from the compressor controller.

The controller 40 is realized by an element or a circuit including a CPU and a memory of a computer as a hardware configuration and is realized by a computer program as a software configuration, but is shown in the drawings as a functional block realized in cooperation therewith. It is clear for those skilled in the art that the functional blocks can be realized in various manners in combination with hardware and software.

Automatically activating the backup chiller 20 through control by the controller 40 is not essential. An operator of the compressor system 100 may manually operate the circulation pump 22, switch a valve, and activate the backup chiller 20.

The backup chiller 20 may not only be used in place of the main chiller 70 but also be (simultaneously) operated together with the main chiller 70. Such a combined use of the main chiller 70 and the backup chiller 20 may be performed not only when the cooling failure of the main chiller 70 has occurred but also when the main chiller 70 operates normally. The cooling capacity of the compressor system 100 can be temporarily enhanced by adding the cooling capacity of the backup chiller 20 to the cooling capacity of the main chiller 70.

As described hereinbefore, in the embodiment, redundancy in cooling the compressor unit 102 is caused by using the backup chiller 20 in place of the main chiller 70 or together with the main chiller 70, in order to circulate a cooling liquid to the liquid-cooled heat exchanger 130 of the compressor unit 102. By operating the backup chiller 20, it is possible to deal with a decrease or loss of cooling capacity caused by the aged degradation or malfunction of the main chiller 70. Alternatively, the cooling capacity of the compressor system 100 can be temporarily enhanced by simultaneously operating the main chiller 70 and the backup chiller 20. In this manner, the cooling function of the compressor unit 102 is stabilized, and the operation continuity and reliability of the compressor unit 102 and the cryocooler 106 are improved.

In addition, while two water-cooled and air-cooled aftercoolers are built in a compressor in a configuration of the related art, the liquid-cooled heat exchanger 130 is disposed in the compressor unit 102 and the backup chiller 20 is provided outside the compressor unit 102 in the compressor system 100 according to the embodiment. For this reason, only the liquid-cooled heat exchanger 130 is included as a standard device, and the compressor unit 102 can be designed in a form of not including the backup chiller 20. The structure of the compressor unit 102 is simplified, leading to cost reduction. The backup chiller 20 can be retrofitted optionally as necessary.

Since the backup chiller 20 is provided outside the compressor unit 102, a degree of freedom in selecting a place to be provided increases. The main chiller 70 is often placed at a remote place from the compressor unit 102 (for example, another room), and the main chiller 70 and the compressor unit 102 are connected to each other by a relatively long cooling liquid pipe. The backup chiller 20 can be disposed by appropriately selecting a place that does not interfere with other devices, such as an empty space from the route of the cooling liquid pipe.

In the embodiment, the backup chiller 20 is a liquid-cooled type. Accordingly, problems peculiar to an air-cooled cooler, such as sticking of a cooling fan, do not occur.

Figure 2:
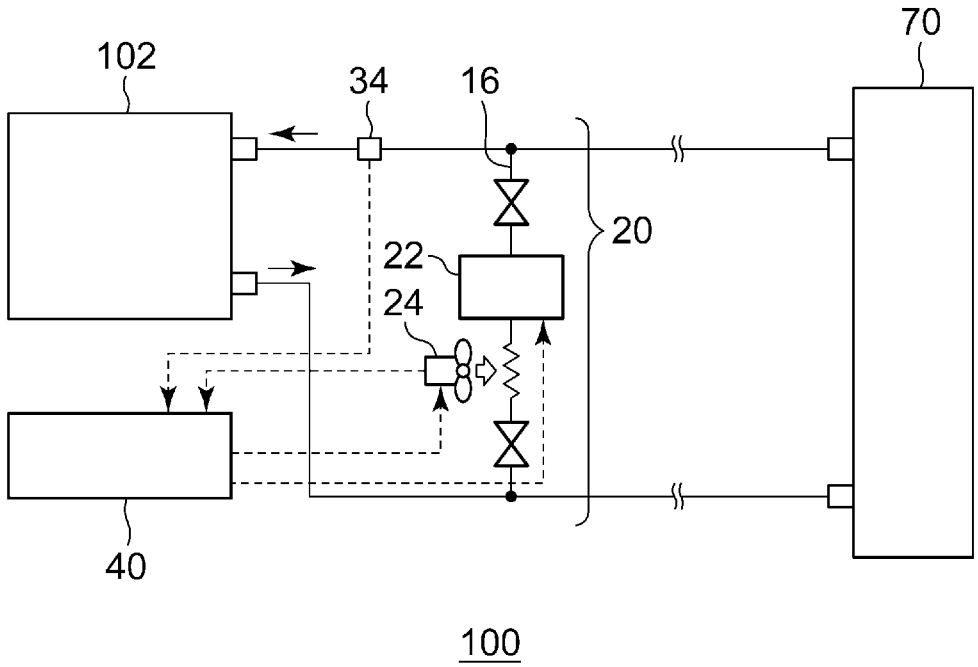
FIG. 2 is a diagram schematically showing a modification example of the compressor system for a cryocooler according to the embodiment.

FIG. 2 is a diagram schematically showing a modification example of the compressor system for a cryocooler according to the embodiment. Also in the embodiment shown in FIG. 2, as similarly shown in FIG. 1, the compressor system 100 includes the backup chiller 20 that is provided outside the compressor unit 102 and circulates a cooling liquid to the compressor unit 102 in place of the main chiller 70 or together with the main chiller 70. The backup chiller 20 includes the circulation pump 22 and the cooler 24. However, the cooler 24 is an air-cooled type, and has a cooling fan disposed to blow wind to the connecting line 16 in order to cool the cooling liquid flowing in the connecting line 16.

In order to confirm the operation of the backup chiller 20, the controller 40 may monitor the backup chiller 20 based on the motor voltage or the current of the cooling fan, instead of the sensor 34 or together with the sensor 34. In addition, the cooling fan may be capable of switching between normal rotation and reverse rotation. In this case, the controller 40 may cause the cooling fan to rotate reversely when it is determined that there is failure in the backup chiller 20. Even when the cooling fan is stuck or clogged with dust, there is a possibility of being eliminated or alleviated by reversely rotating the fan.

The present invention has been described based on the embodiment. It is clear for those skilled in the art that the present invention is not limited to the embodiment, various design changes are possible, various modification examples are possible, and such modification examples are also within the scope of the present invention. Various characteristics described related to one embodiment are also applicable to the other embodiment. A new embodiment generated through combination also has the effects of each of the combined embodiments.

Although the backup chiller 20 and the main chiller 70 are connected in parallel with each other with respect to the liquid-cooled heat exchanger 130 of the compressor unit 102 in the embodiment described above, the present invention is not limited thereto. In one embodiment, the backup chiller 20 and the main chiller 70 may be connected in series. In this case, the backup chiller 20 may be provided on the supply line 12 (or the collecting line 14).

Without being limited to the liquid-cooled or air-cooled cooler described above, the cooler 24 of the backup chiller 20 may be, for example, another type of cooler, such as cooling a cooling liquid by a cooling element (for example, a Peltier element).

Although the present invention has been described using specific phrases based on the embodiment, the embodiment merely shows one aspect of the principles and applications of the present invention, and many modification examples and changes in disposition are allowed without departing from the gist of the present invention defined in the claims.

It should be understood that the invention is not limited to the above-described embodiment, but may be modified into various forms on the basis of the spirit of the invention. Additionally, the modifications are included in the scope of the invention.

What is claimed is:

1. A compressor system for a cryocooler comprising:

a compressor unit that includes a compressor main body compressing a refrigerant gas of the cryocooler and a liquid-cooled heat exchanger cooling, through heat exchange with a cooling liquid, at least one of the refrigerant gas compressed by the compressor main body and an oil lubricating the compressor main body;

a supply line through which the cooling liquid is supplied from a main chiller to the liquid-cooled heat exchanger;

a collecting line through which the cooling liquid is collected from the liquid-cooled heat exchanger to the main chiller; and a backup chiller that is provided outside the compressor unit, circulates the cooling liquid to the liquid-cooled heat exchanger in place of the main chiller or together with the main chiller, and includes a circulation pump and a cooler cooling the cooling liquid on an inlet side or an outlet side of the circulation pump.

2. The compressor system for a cryocooler according to claim 1, wherein the backup chiller includes a connecting line connecting the supply line and the collecting line to each other, and wherein the circulation pump and the cooler are provided on the connecting line.

3. The compressor system for a cryocooler according to claim 2, further comprising:

a bypass line that connects the supply line and the collecting line to each other on a main chiller side with respect to the connecting line and is a part of a flow path which bypasses the liquid-cooled heat exchanger and the backup chiller to circulate the cooling liquid to the main chiller.

4. The compressor system for a cryocooler according to claim 2, wherein each of the supply line and the collecting line is separably connected to the main chiller on a main chiller side with respect to the connecting line.

5. The compressor system for a cryocooler according to claim 1, wherein the compressor unit includes a temperature sensor that measures a temperature of the cooling liquid, the refrigerant gas, or the oil, and the backup chiller includes a controller that activates the backup chiller based on the temperature of the cooling liquid, the refrigerant gas, or the oil, which is measured by the temperature sensor.

6. The compressor system for a cryocooler according to claim 1, wherein the backup chiller includes a sensor measuring a temperature, flow rate, or a pressure of the cooling liquid and a controller activating the backup chiller based on the temperature, the flow rate, or the pressure of the cooling liquid, which is measured by the sensor.

7. An auxiliary cooling device for a compressor unit for a cryocooler, comprising:

a supply line through which a cooling liquid is supplied from a main chiller to a liquid-cooled heat exchanger built in the compressor unit;

a collecting line through which the cooling liquid is collected from the liquid-cooled heat exchanger to the main chiller; and a backup chiller that is provided outside the compressor unit, circulates the cooling liquid to the liquid-cooled heat exchanger in place of the main chiller or together with the main chiller, and includes a circulation pump and a cooler cooling the cooling liquid on an inlet side or an outlet side of the circulation pump.

* * * * *